United States Patent [19]

Galaini et al.

[11] 4,182,541

[45] Jan. 8, 1980

[54] BURGLAR ALARM FOIL BLOCK

[76] Inventors: James L. Galaini, 115 Hammler Rd.; Scott G. Kindred, 101 Taylor Ave., both of Somerville, N.J. 08876

[21] Appl. No.: 864,880

[22] Filed: Dec. 27, 1977

[51] Int. Cl.[2] ..... H01R 9/22

[52] U.S. Cl. ..... 339/125 R; 339/244 R

[58] Field of Search ..... 339/125 R, 119 R, 198 T, 339/198 GA, 263 L, 17 T, 98, 75 R, 75 N, 176 MF; 219/522, 541; 340/274 R, 276

[56] References Cited

U.S. PATENT DOCUMENTS

| | | | |
|---|---|---|---|
| 2,922,979 | 1/1960 | Cassell | 339/17 |
| 3,140,138 | 7/1964 | Koletsos et al. | 339/97 |
| 3,221,096 | 11/1965 | Croghan | 339/176 MF |
| 3,388,370 | 6/1968 | Elm | 339/98 |
| 3,781,767 | 12/1973 | Guthart | 399/17 T X |
| 3,813,636 | 5/1974 | Mason | 339/75 R X |
| 3,899,236 | 8/1975 | Santos | 339/98 |
| 3,911,414 | 10/1975 | Bowling | 339/17 T X |
| 3,920,305 | 11/1975 | Scott | 339/98 |

*Primary Examiner*—E. F. Desmond

[57] ABSTRACT

In a preferred embodiment, there is provided a molded one-piece foil block having a hinged cover as a part of the unitary molded unit, shaped for the cover to clamp downwardly upon each of electrical lead wires and electrically conductive strip normally known as foil, and in the clamped state the cover by virtue of the shape thereof and of the block, snapping into a locked state, and a surface of the block or cover carrying contact adhesive masked by removable masking sheet, the block and cover and hinge interconnecting the two, all being of polypropylene plastic of a substantially flexible nature, and opposing faces of the block and cover in a clamping state, having a plurality of randomly raised portions positioned to substantially mesh with one-another in the clamping state whereby the clamped foil and lead wires are caused to be integrally pressed into improved electrical contact with consequent improved transmission of electric current from one to the other, and the block and cover jointly being further shaped as to firmly grip the lead wire inserted thereinto against the possibility of jerking action thereon disturbing seated wires thereof in electrical contact with the foil.

9 Claims, 12 Drawing Figures

PRIOR ART

BURGLAR ALARM FOIL BLOCK

This invention relates to a novel foil block as a part of a burglar alarm system.

BACKGROUND TO THE INVENTION

Prior to the present invention, typical foil blocks for a burglar alarm system such as is utilized on glass windows to initiate an alarm if the glass is broken thereby breaking the foil with a thereby consequent break in electrical circuitry, are of the general structure shown in the Prior Art Figure of the drawings. It will be observed that there is a metal clamp which has to be carefully placed over the foil, and the wire is attached by a screw which concurrently clamps-down the foil beneath the clamp. The multiple parts and nature thereof make the unit very expensive, but of even greater importance is the unduly large amount of time and great difficulty in properly mounting the strip of foil and securely connecting the lead wire in good electrical contact; even for a skilled and experienced mechanic in the installation thereof, there is experienced considerable difficulty, and the excessive amount of time required causes the cost of installation to be very high. There is the added nuisance of keeping-up with several dismounted parts, which one or more thereof are frequently lost. Once the strip of foil is in position, and the metal clamp in position, the screw has to be inserted without crossing threads, and the screw is small and short, and difficult to handle, while also supporting the small block and clamp; then the wire also has to be held in proper position while with a screw driver the workman attempts to turn and screw-down the screw. Such is a process easier said than done.

SUMMARY OF THE INVENTION

Accordingly, objects of the present invention include obtaining a novel foil block device overcoming and/or avoiding problems and difficulties of the types discussed above.

In particular, another object is to obtain a unitary foil block and clamp mechanism.

Another object is to obtain a foil block and clamping mechanism enabling speedy and effective locking-together of electrical lead wire(s) and an electrically conductive strip, commonly known as foil or foil strip.

Another object is to obtain a foil block having a wire and foil mounting mechanism of snap-on design for the anchoring thereof.

Another object is to obtain a foil block and wire and foil mounting mechanism of a design providing for speedy mounting and for establishing good and effective electrical contact between the electrical wire and the strip of foil.

Another object is to obtain one or more of the preceeding objects together with reduced time and greater ease in the mounting of the lead wire and foil.

Another object is to simplify the mechanism and reduce the time of applying the block to a window pane or window or door frame.

Another object is to avoid multiple parts, as well as to obtain an effective mount and clamp as a foil block out of inexpensive material.

Other objects become apparent from the preceding and following disclosure.

One or more objects of the invention are obtained by the invention as typically illustrated in the accompanying drawings, which are not intended to unduly limit the scope of the invention but rather to serve to illustrate the controlling features thereof.

Broadly the invention may be described as a burglar electrical strip or foil device which includes what is conventionally referred to as a foil block, this foil block as a first member, having a first surface that will be a clamping surface, and the device further including a second member that might reasonably be termed a "cover" as a clamping member having a clamping face as a second surface which in a clamping state is in face-to-face opposition and relationship and contact with the first surface. The respective foil block and cover are jointly so-shaped such that they snap-together, locking therebetween the strip of foil and one or more wires of a lead electrical wire, compressed together between the opposing faces.

In a particularly preferred embodiment the composition of the foil block and the cover are a substantially flexible plastic, such that cost of production thereof typically by molding is low, and such that the plastic serves as insulation. A preferred plastic is polypropylene because of its resiliency, strength and durability at diverse temperatures over a wide range, as well as being a low cost plastic well adapted for molding into such a device. It is to be recognized, however, that one of the block and the cover may be of a different material.

In a further and more preferred embodiment having an advantage of being anchored-together to avoid loss of parts, as well as ease of maneuvering-together the block and cover, the foil block and the cover are connected preferably at one edge thereof in a hinge-like manner, preferably by interconnecting plastic, such as all of the foil block, the hinge, and the cover being of polypropylene plastic. In such embodiment, the entire unit advantageously can be molded in a single operation.

In still another preferred embodiment, the clamping surfaces, one or more thereof, have spaced-apart raised surfaces, preferably on each of the opposing first and second opposing surfaces so-positioned such that when in a clamping state, the opposing raised surfaces are intermeshed, thereby serving to effectively press-together into more intimate and effective electrical contact the electrical wire(s) and the electrical strip such as the foil, thereby avoiding false alarms that plague prior devices which become loosened over a period of time as a result of environmental vibrations.

The mechanism of snapping-together is preferaby achieved by virtue of one of the foil block and the cover, having a stepped side-face, and the other thereof having an overhang shaped and positioned to slip-past a tight-fit into the stepped space, as a snap-in lock.

As one preferred embodiment, an aperture extends through the plastic hinge (or other hinge) to thereby prevent shifting of the lead wire, as well as the hinge serving to further clamp the wire to tightly anchor the same, as the cover is pulled tightly to the snap-on position.

In an alternate embodiment, the lead wire is simply and easily placed into a groove, while seating the contact-wire(s) end thereof upon the clamping surface of the block, and the cover thereafter snapping-down to clamp-upon the lead-wire at the slot, as well as the normally clamping surface of the cover securing thereunder the contact wire(s) and foil into an intimate electrical contact.

Preferably, as in the above-described embodiments, there are thus-provided separate insert spaces for the lead wire and the strip of conductive foil, respectively, and preferably such that the lead wire(s) and the strip of foil are positioned with their longitudinal axes substantially normal (right-angle) to each-other, such having the advantage that pulling pressure on one does not pull-away from an insertion position of an opposite direction for the other.

Advantageously, the device—either the cover or the block, is provided with either an adhesive coating or with an adhesive-faced tape, for the adhesive attaching of the device to a smooth surface such as a glass pane or a window or door frame. While a tape having adhesive material on each of opposite faces may be advantageously utilized, preferably a contact adhesive, having the face thereof (whether contact adhesive or double-faced tape) covered with a masking sheet easily removed at the point of use.

The invention may be better understood by making reference to the following Figures.

THE FIGURES

DETAILED DESCRIPTION

Figure 1:
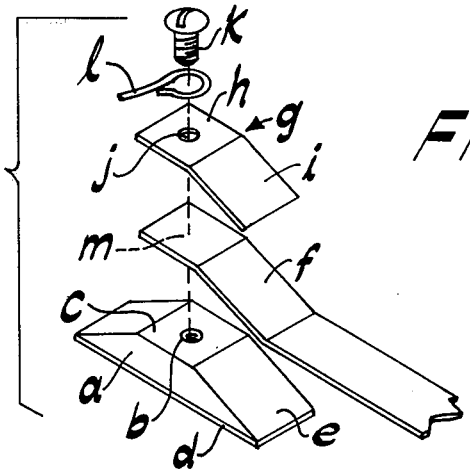
FIG. 1 illustrates the practice of the prior art.

The prior art figure already discussed-above in the Background, shown in exploded view, FIG. 1, illustrates a typical foil block a, having a female threaded receptacle b in its upper face c, an adhesive base with double-faced adhesive, for mounting, the adhesive being d, and having one or more ramps e. The electrically conductive strip of foil f becomes conformed to the shape of the upper face c and the ramp e by virtue of a metal clip g having a shape corresponding to the upper face c and ramp e, which compresses and holds the strip of foil f when anchored by the male-threaded shaft of the screw k passes through a wire loop of a lead wire 1, through an aperture j of face h and forcefully through point m of the strip of foil f, matingly into the female threaded receptacle b; thereby the screw anchors the lead wire, and when anchored, also the metal clip g has portion i forcefully anchoring the foil f along the ramp e.

In contrast thereto, the device of the present invention includes a base block 1 and a lid 2 connected with a hinge 3 having an aperture 4 therethrough for receipt of a lead wire 5. As a part of the lid 2 there is a hook or snap-portion 6 which flexibly snaps-over a ridge-portion 7 of the foil block 1 formed by a step-space 8. A ramp portion 9 rises above the connecting point of the hinge 3, serving as a wedge-abutment against which the lead wire 5 becomes pressed when the lid 2 is in a snapped state as shown in FIGS. 2A, 4, 5, 6, and 7, and also in FIG. 3B, whereby the lead wire is clamped to avoid the possibility of the finer wires **5*a*, 5*b* and 5*c* being disturbed or pulled from proper electrical contact position as a result of accidental jerks or pulls on either of the lead wire and mounting device relative to one-another. The ramp 10 serves as a raised-portion around-which the flexible snap-portion 6 is stretched (enveloped to facilitate a tight clamping fit of the lid face 2*a* against the block face 1*a* in the state of clamping the strip of foil 11 enveloped therebetween in contact with the wires 5*a*, 5*b*, etc., for the several embodiments. To further enhance electrical contact between the strip of foil and the wires clamped together, the lid has raised-portions 12*a* and the block face 1*a* has the raised-portions 12*b*, which intermesh when the lid is in a clamped state as shown in FIGS. 2, 2A, 3, 3A, 4, 5, 6, 7, 8 and 9, but illustrated only in FIGS. 1A, 4, 6 and 9, resulting in improved contact for electrical conductance between the wires and the strip of foil, as well as improving the anchoring of both the wires and the foil between the lid 2 and the block 1**.

There is provided either a tape having two opposite faces coated with adhesive, or alternately and preferably a contact adhesive of conventional type and nature, coated on a face of either the block or the lid, preferably a masking sheet covering the exposed (outer) surface of the adhesive in either embodiment of tape or contact adhesive, being removable manually at the point and time of use when mounting the device on a door or window frame or glass pane thereof.

Figure 1A:
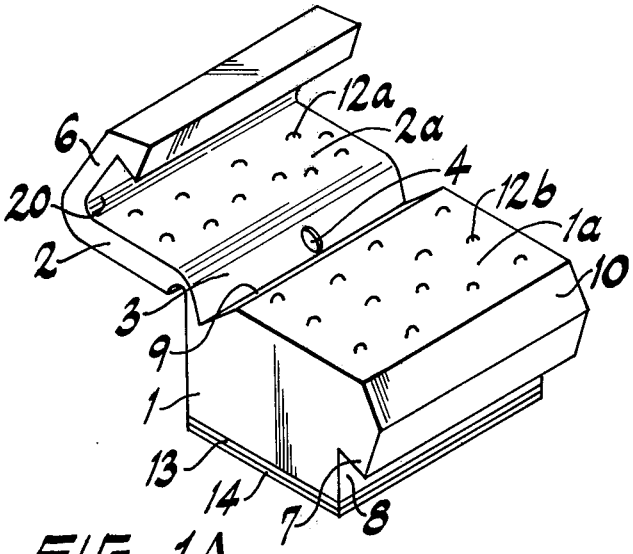
FIG. 1A illustrates the appearance of a typical embodiment of one of the preferred embodiments of the invention, shown in front perspective view in an open unclamped state before use.
Figure 2:
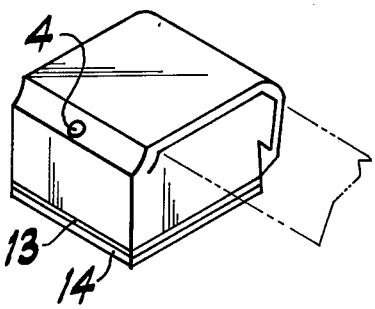
FIG. 2 illustrates a back (rear) perspective view of the embodiment of FIG. 1A.
Figure 3A:
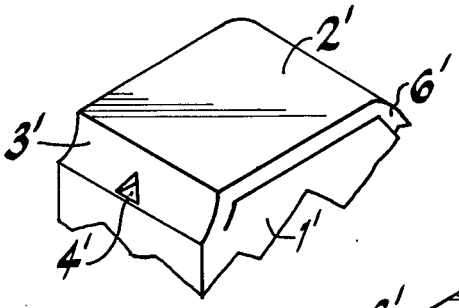
FIG. 3A illustrates, in part view, an alternate embodiment, having a triangular lead wire-insertion aperture, otherwise identical to the embodiment of FIG. 1A.
Figure 2A:
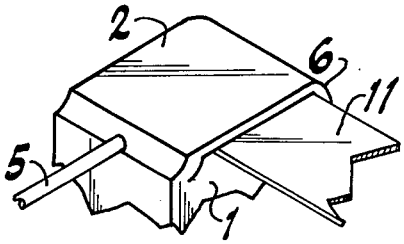
FIG. 2A shows wire and foil mounted.
Figure 3B:
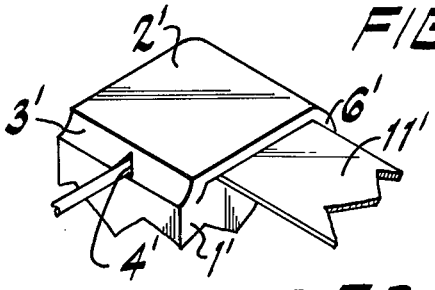
FIG. 3B illustrates the FIG. 3A embodiment as it appears with the lead wire inserted and with the strip of foil also clamped in the mounted state, as in the part view of FIG. 2A.
Figure 4:
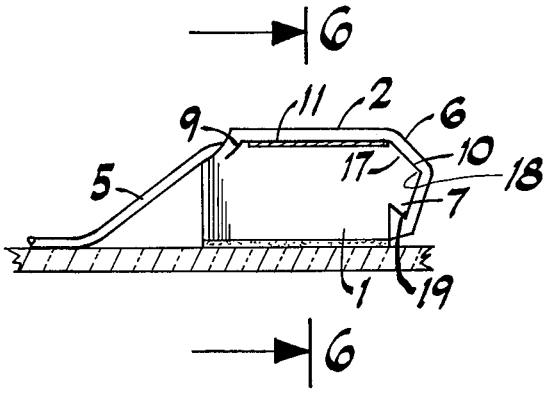
FIG. 4 illustrates the FIGS. 1A, 2, 2A embodiment in an operative mounted state on a glass pane, in side view, cross-section through the pane, and through the electrically conductive strip of foil.
Figure 5:
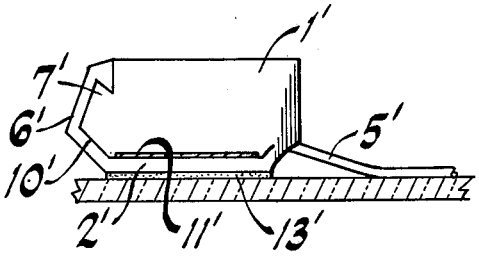
FIG. 5 illustrate an embodiment as an alternate that is substantially similar or identical to the FIG. 4 embodiment, except for the adhesive being on the lid, for inverted mounting on the pane, also shown in side view with cross-section through the pane and the strip of foil.
Figure 6:
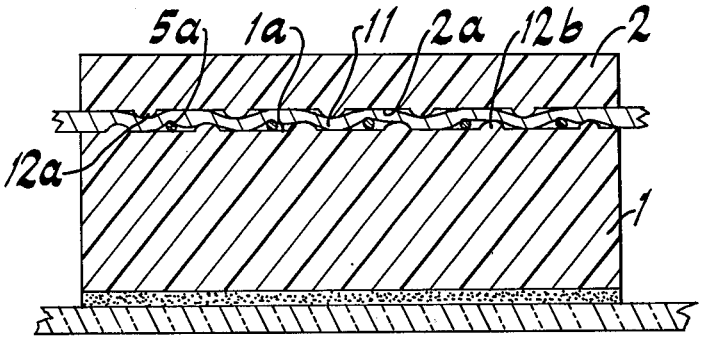
FIG. 6 illustrates a typical cross-sectional view as taken along lines 6—6 of FIG. 4.
Figure 7:
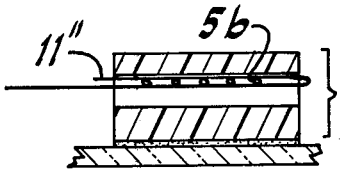
FIG. 7 illustrates an alternate embodiment of mechanism of mounting the lead wire and strip of foil, shown symbolically, in which the strip of foil is folded-back over the spread-apart wires, encapsulating the wires thereby making better contact electrically, shown diagrammatically in an exploded side cross-sectional view comparable to the view of FIG. 6.

The FIGS. 3A and 3B embodiment is the same as that of FIG. 1A, except for a triangular aperture, with the point upwardly such that upon the insertion—with the lid open—of the lead wire, there is the broad lower portion and space of the triangular aperture, and such that upon the closing and clamping and locking of the lid, the lead wire becomes wedged into the narrowed space of the upper point of the triangular space, thereby enhancing the securing and anchoring of the lead wire, thus avoiding accidental disturbing of the wires **5*a* from their seated position when clamped. Accordingly, triangular aperture 4'** is a preferred embodiment.

Figure 8:
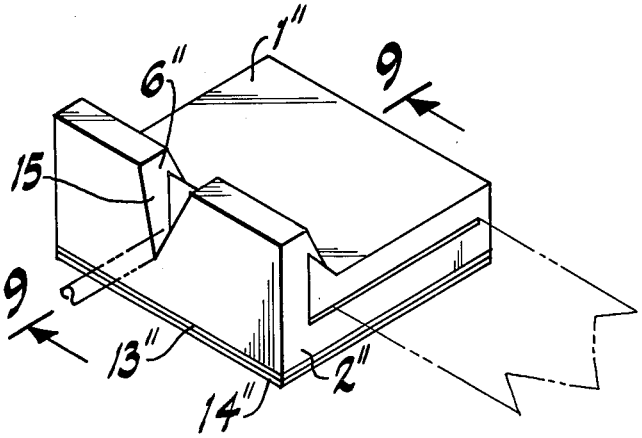
FIG. 8 illustrates an alternate embodiment somewhat similar to the FIG. 5 embodiment, except with a different mechanism and design for lead-wire insertion, in front perspective view.
Figure 9:
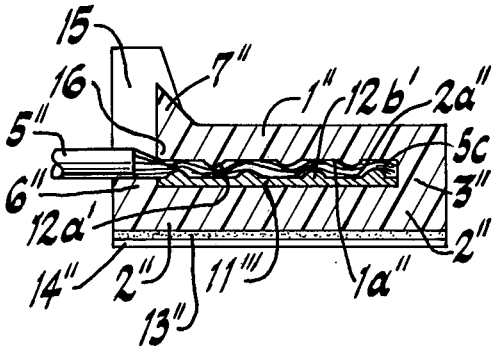
FIG. 9 is a cross-sectional view along lines 9—9 of FIG. 8.

The FIGS. 8 and 9 embodiment is further preferred in the alternate wedge-mounting slot 15 into which the lead wire 5" is laid before snapping the block 1" under the catch of the snap-portion 6", the edge and corner 16 of the ridge portion 7" serving to clamp the lead wire into the cleft of the slot 15, as the wires 5*c* thereof become clamped and anchored between the faces 1*a*" and 2*a*", and the raised portions 12*a*' and 12*b*' thereof, against the electrically conductive strip of foil 11'". The contact adhesive 13" has removable masking tape 14" mounted thereon.

The preferred angles respectively at various points are 17 at about 120 degrees, 18 at about 60 degrees, and 19 at about 30, in order to insure most effective snap and clamping action. The point 20 (curve) is to about 88 degrees or less. It must be understood that there can be other angles (degrees) but with less effectiveness.

Likewise, there may be employed, with alternate embodiments of this invention, any of many possible conventional or desired other shapes of catches and/or snap-on shapes, still within the broader scope of the invention, it being within the scope of the invention to use variations and modifications apparent to a skilled mechanic or artisan in this particular field.

I claim:

1. A burglar electrical strip device comprising in combination: a first member having a first surface of predetermined area and a second member having a second surface of predetermined area, at least one of said first and second surfaces including at least one raised portion positioned to facilitate clamping pressure at least on one of electrical strip and an electrical wire of an electrical lead; the first and second surfaces being shaped to be adapted for being placed together in substantially face-to-face opposing relationship and in substantial contact with one-another, and further being jointly adapted to receive therebetween both an electrically conductive strip and one or more contact wires of an electrical lead wire in electricl contact with the conductive strip and in an anchored and compressed state between the first and second surfaces, and the first and second members jointly including latching means for latching the first and second members together with the first and second surfaces in opposing relationships.

2. A burglar electrical device of claim 1, including the first and second members being structured as to provide separate insertion openings for each respectively of an electrical strip and wires of a lead wire, said separate insertion openings being positioned such that they are in other than opposing relationship whereby longitudinal axes of an inserted lead wire and of a strip of electrically conductive strip are substantially at right-angles to one-another.

3. A burglar electrical device of claim 1, in which the latching means includes the first and second members being shaped such that one of the first and second members folds around the other thereof and snap-latches onto the other.

4. A burglar electrical device of claim 3, including said other of said first and second members having a stepped portion around which said one snap-latches.

5. A burglar electrical device of claim 4, wherein said first and second members are of polypropylene material, and including a lead wire insertion aperture extending through a hinge between said first and second members from exterior space to a location between the first and second surfaces.

6. A burglar electrical device of claim 4, including a slot having one open end extending through and from an edge of a latching portion of one of the first and second members.

7. A burglar electrical device of claim 4, including adhesive composition on an exterior face of at least one of said first and second members, applied as a coating, and a masking sheet removably masking an exterior surface of said coating.

8. A burglar electrical device of claim 1, including adhesive composition on an exterior face of at least one of said first and second members.

9. A burgler electrical device of claim 8, in which said adhesive is contact adhesive, applied as a coating, and a masking sheet removably masking an exterior surface of said coating.

* * * * *